US005622197A

United States Patent [19]

Valaire

[11] Patent Number: 5,622,197

[45] Date of Patent: Apr. 22, 1997

[54] CANOPY

[76] Inventor: Trevor Valaire, 25 Darling Street, Balmian, New South Wales, Australia, 2040

[21] Appl. No.: 411,962

[22] Filed: Mar. 9, 1995

[30] Foreign Application Priority Data

Mar. 9, 1994 [AU] Australia ..... PM4345

[51] Int. Cl.[6] ..... B63H 9/00; E04H 15/32

[52] U.S. Cl. ..... 135/90; 114/106; 114/107; 135/87; 135/115; 135/903; 135/123; 135/152; 135/117; 135/120.4

[58] Field of Search ..... 135/87, 90, 123, 135/152, 157, 161, 117, 120.4, 115, 119, 903, 905, 913, 900; 242/388.1, 388.5; 114/104, 105, 106, 107

[56] References Cited

U.S. PATENT DOCUMENTS

| | | | |
|---|---|---|---|
| 1,654,422 | 11/1927 | Laggren | 135/115 X |
| 2,886,047 | 5/1959 | Healy | 135/87 X |
| 2,928,405 | 3/1960 | Lawson | 135/87 X |
| 3,060,949 | 10/1962 | Moss | 135/87 |
| 3,581,436 | 6/1971 | Basiger | 135/87 X |
| 3,602,180 | 8/1971 | Holmes | 114/107 |
| 3,872,816 | 3/1975 | Cutts | 114/106 |
| 4,449,467 | 5/1984 | Hild et al. | 114/107 X |
| 4,723,499 | 2/1988 | Furgang | 114/106 |
| 5,080,123 | 1/1992 | Stein | 135/900 X |
| 5,415,194 | 5/1995 | Kaye | 135/900 X |

FOREIGN PATENT DOCUMENTS

| | | | |
|---|---|---|---|
| 630782 | 11/1961 | Canada | 135/87 |

*Primary Examiner*—Wynn E. Wood

*Attorney, Agent, or Firm*—Gifford, Krass, Groh, Sprinkle, Patmore, Anderson & Citkowski, P.C.

[57] ABSTRACT

A canopy assembly (10) comprising a canopy fabric (20) and furling means (40) extending between a pair of supports (30). The furling means (40) runs through the canopy fabric such that the canopy may be unfurled from both sides of the furling means simultaneously. Both free corners (22, 24) of the unfurled canopy are tethered to the ground or posts (50) to provide a taut smooth canopy. The tension in the furling means (40) is adjustable such that it remains substantially straight and taut in a furling condition, and in an erected condition may be relaxed to conform to the curved shape of the canopy.

32 Claims, 5 Drawing Sheets

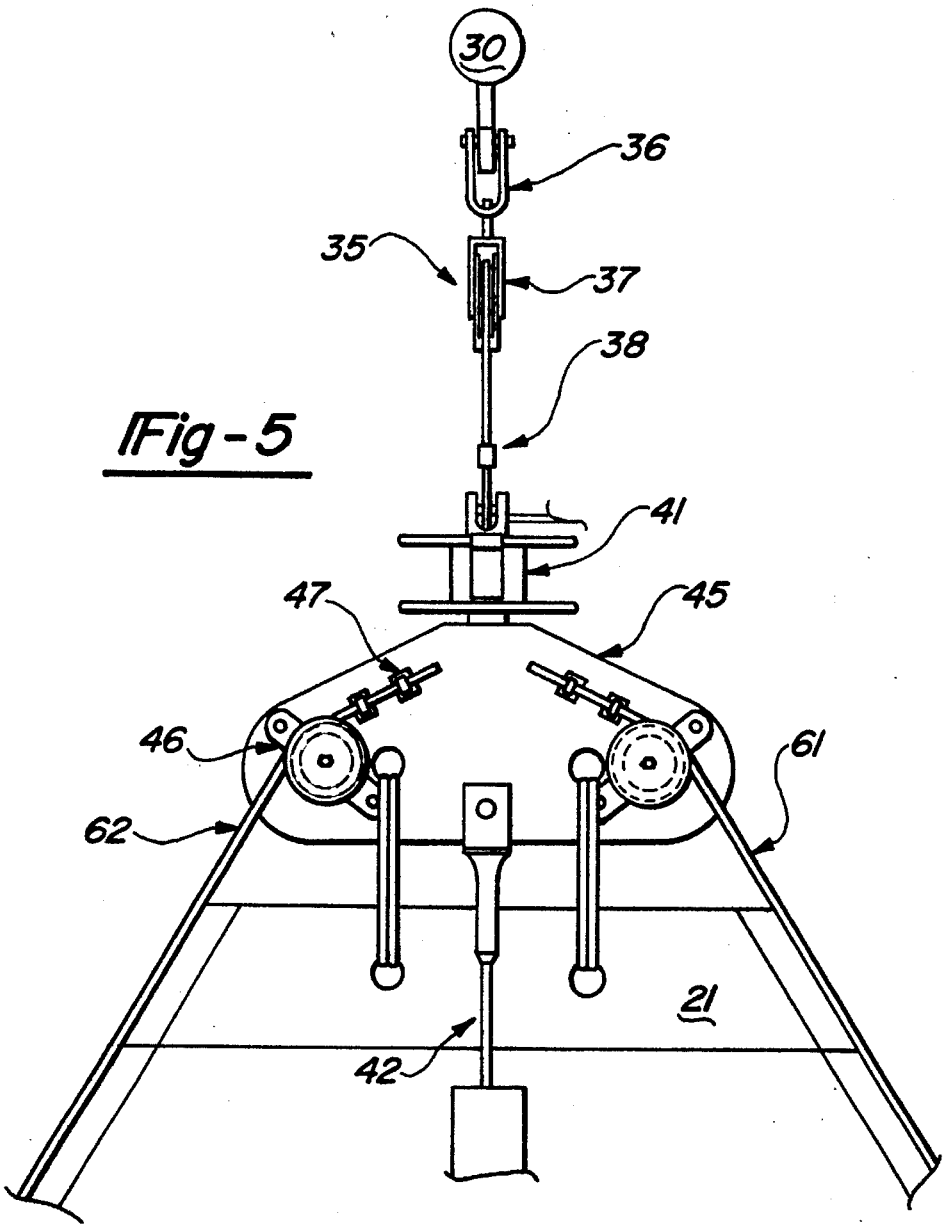
Fig-5
Fig-6
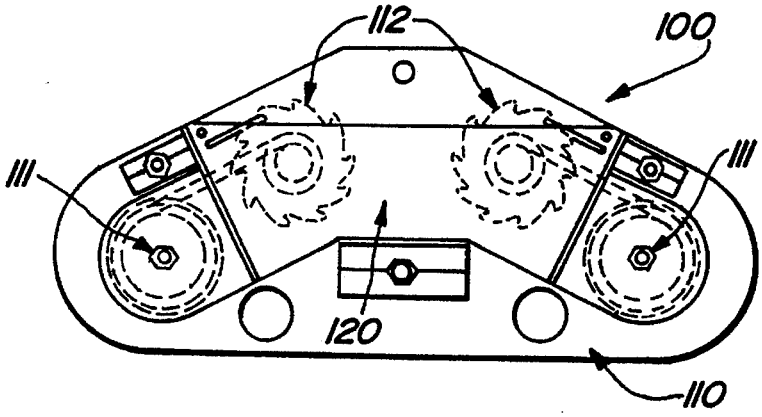

CANOPY

The present invention relates to canopies and in particular to adjustable or collapsible canopies.

Canopies or shelters fall into two major categories either permanent or collapsible. Most rigid canopies made from wood, sheet metal or alloy etc are permanent and quite expensive to construct. Other canopies are comprised of flexible fabric or cloth that is stretched out and supported by a solid frame. The frame is usually a simple rectangular or triangulated skeleton with the canopy connected at several points.

Such canopies are not only time consuming to erect but have limited aesthetic appeal and are not easily adjustable or collapsible.

Collapsible or adjustable canopies are becoming more popular. A collapsible canopy allows one to choose whether an area is exposed or protected from ambient conditions and control the amount of sunlight and precipitation which falls on the area below the canopy to take maximum advantage of the weather.

In the past these collapsible canopies were quite limited in size and shape and were typically quite expensive to build, even for small areas to be protected, were not very robust and had a limited ability to resist wind forces. For example, the most common form of collapsible canopy is the umbrella type, which is limited to essentially round or square shapes of relatively small size and typically have a central pole which occupies the most protected area under the canopy.

Larger canopies usually require substantial scaffolding and/or mechanical devices to effect erection of the canopy or allow an operator to cover or expose as much of the ground area as is desired. It is also difficult with such collapsible or adjustable canopies to obtain good run-off of water or debris from the canopy top, particularly if the canopy is made from a flexible fabric or cloth, due to the difficulty in keeping such a fabric taut over the canopy frame.

In addition these larger adjustable canopies are usually rolled up or furled along one edge. This places limitations on the size and shape of the canopy and further the folded canopy is not in a desirable location, since the canopy is typically furled along one of its lower edges. Further, furling from an edge is quite time consuming and difficult due to the size of most canopies or awnings. Rolling along one edge also increases the tendency for creasing and wrinkling of the canopy which can become quite unsightly, hinder furling and possibly damage the canopy fabric.

In an effort to ameliorate the disadvantages of the prior art or at least provide a commercial alternative to the prior art it is proposed to provide a canopy which is simple and inexpensive to produce and which, at least in the preferred embodiments, is easily erected and adjusted.

In a first aspect, the present invention provides a canopy assembly comprising a canopy fabric or cloth with a plurality of anchor points on its periphery, a pair of supports adapted to suspend said canopy fabric above the ground and a furling means extending along said canopy fabric between said supports such that said fabric is adapted to be unfurled from both sides of the furling means simultaneously and connected to the ground or posts by tethers extending from said anchor points.

The furling means preferably comprises a flexible coupling such as a cord, a cable, a plurality of articulated rigid elements or the like.

In a preferred embodiment, a furling reel is provided adjacent one of the supports and a barrel or swivel is provided adjacent the other of the supports with a flexible coupling extending therebetween to transfer rotational movement from the reel to the barrel or swivel.

In another embodiment, said canopy further comprises tensionable cables running along the periphery of said canopy fabric between the corners of said fabric.

By providing a canopy fabric or cloth that is unfurled from both sides of a furling means, the canopy fabric may be fully unfurled in approximately half the time and half the number of rotations of the furling means as compared to furling along one edge. The equal, and opposite tension applied to the furling means during furling or unfurling and the relatively symmetrical positioning of the furling means on the canopy fabric also reduces the stresses applied to the furling means during deployment and retraction of the canopy fabric and also reduces creasing or wrinkling of the canopy fabric due to the fewer number of rotations of the furling means.

Of course for very large canopies two or more sets of supports and furling means may be provided.

In a second aspect, the present invention provides a canopy assembly comprising a canopy fabric or cloth, support means to suspend said canopy fabric or cloth above the ground and a furling means adapted to furl said fabric or cloth wherein, in a furling condition said furling means is substantially straight, and in an erected condition said furling means conforms to the curved shape of the tensioned canopy fabric cloth.

According to this aspect of the present invention, the tension in the furling cable may be adjusted. In this way, the furling cable may be tensioned to provide a relatively straight furling means, thereby facilitating furling of the canopy fabric, yet when required the furling cable may be relaxed to conform to whatever curved shape is formed by the canopy fabric. Further, having such a flexible furling means allows the canopy to be any desired shape, since it is not limited or defined by the shape of the furling apparatus.

In yet a further aspect, the present invention provides a method for erecting a canopy comprising the steps of providing a pair of spaced apart supports, positioning a canopy fabric between said supports such that each support is on substantially opposite sides of said canopy fabric suspending the canopy fabric above the ground by connecting said fabric to said supports with a furling means extending along said canopy fabric and unfurling the canopy fabric simultaneously from both sides of the furling means.

It is envisaged that the present inventive canopy may be used in a variety of ways including simple shade, shielding for crops from hall or frost, dew or precipitation collection for irrigation or solar energy collection.

In order that the present invention may be more clearly understood preferred embodiments will now be described, by way of example only, with reference to the accompanying drawings, in which.

Figure 4:
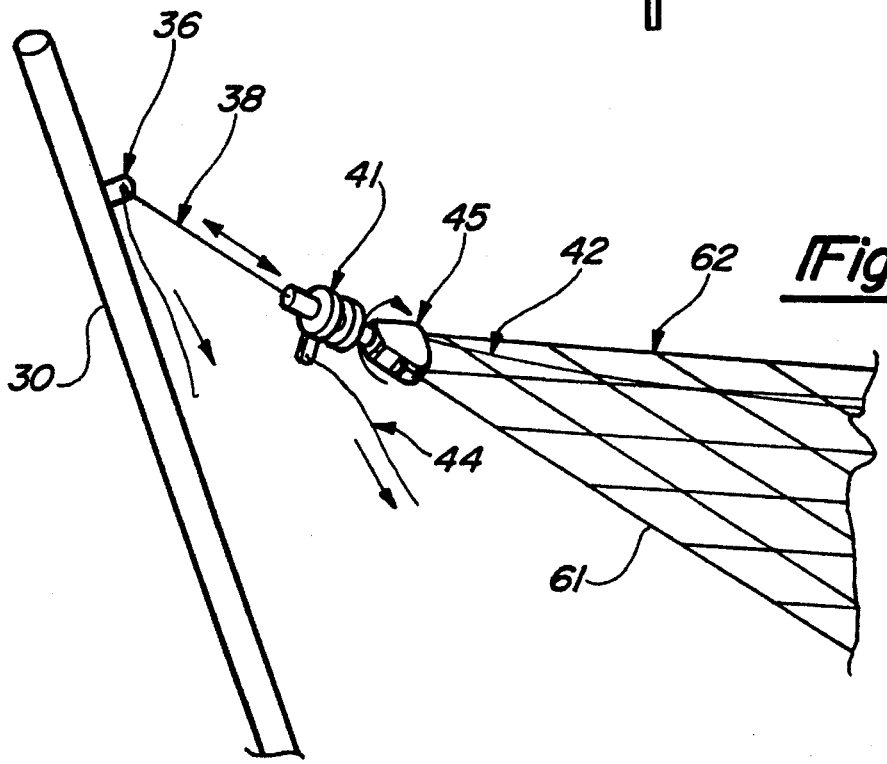
Figure 8:
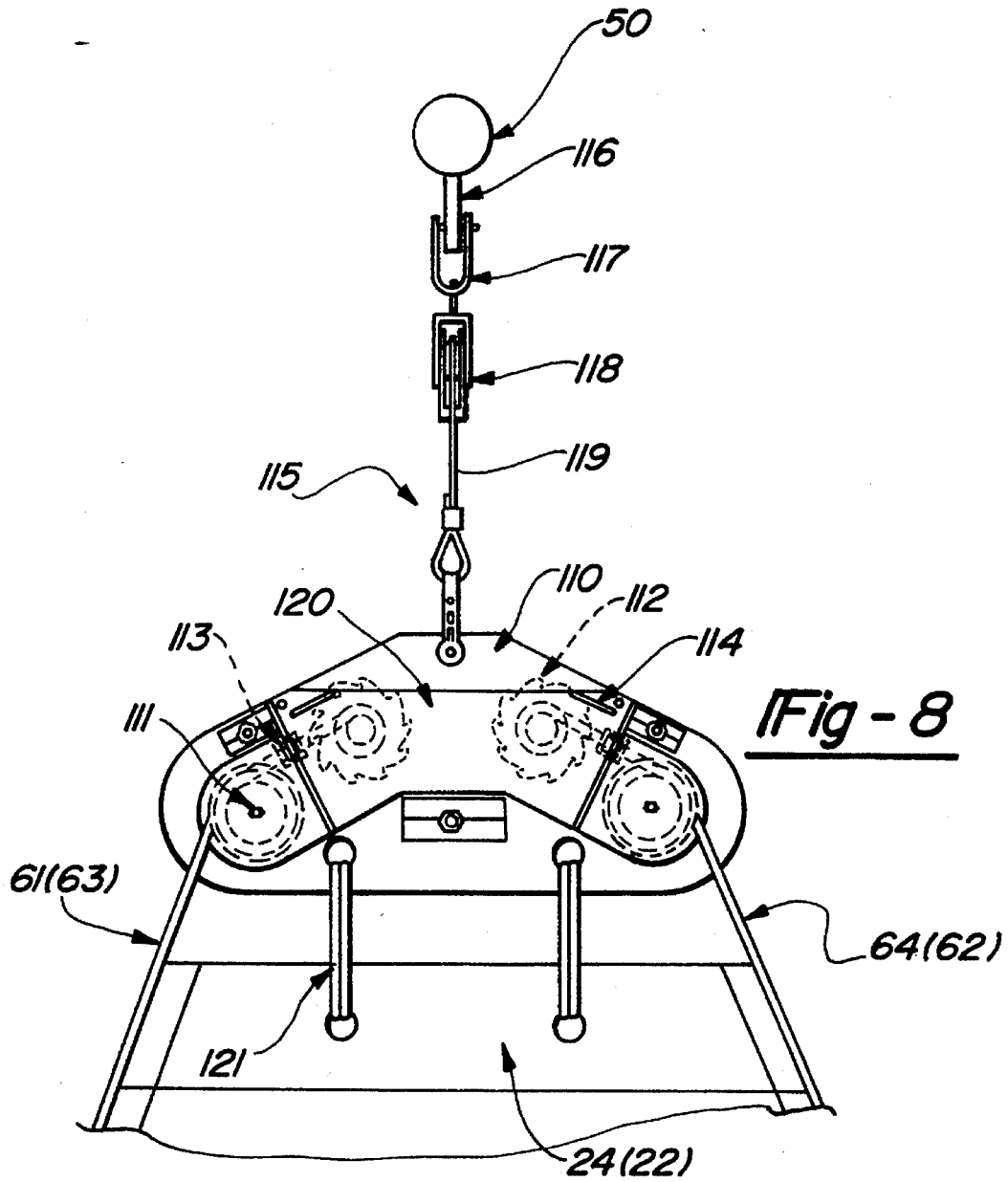
Figure 7:
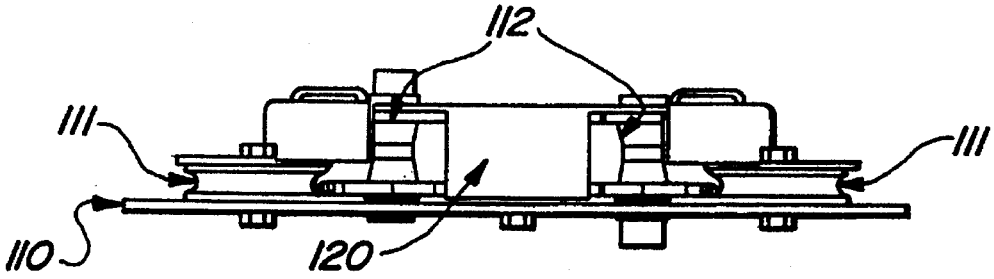

FIGS. 3A–E are perspective views of the furling of the inventive canopy assembly;

FIG. 4 is a perspective view of a furler reel means used to furl/unfurl the canopy fabric of the inventive canopy assembly;

FIG. 5 is a plan view of a furler reel means and passive tensioner;

FIGS. 6 and 7 are plan and side elevational views respectively of an active tensioner for altering tension of a canopy fabric according to another embodiment of the present invention; and FIG. 8 is a plan view of the active tensioner of FIGS. 6 and 7 in use.

Figure 1:
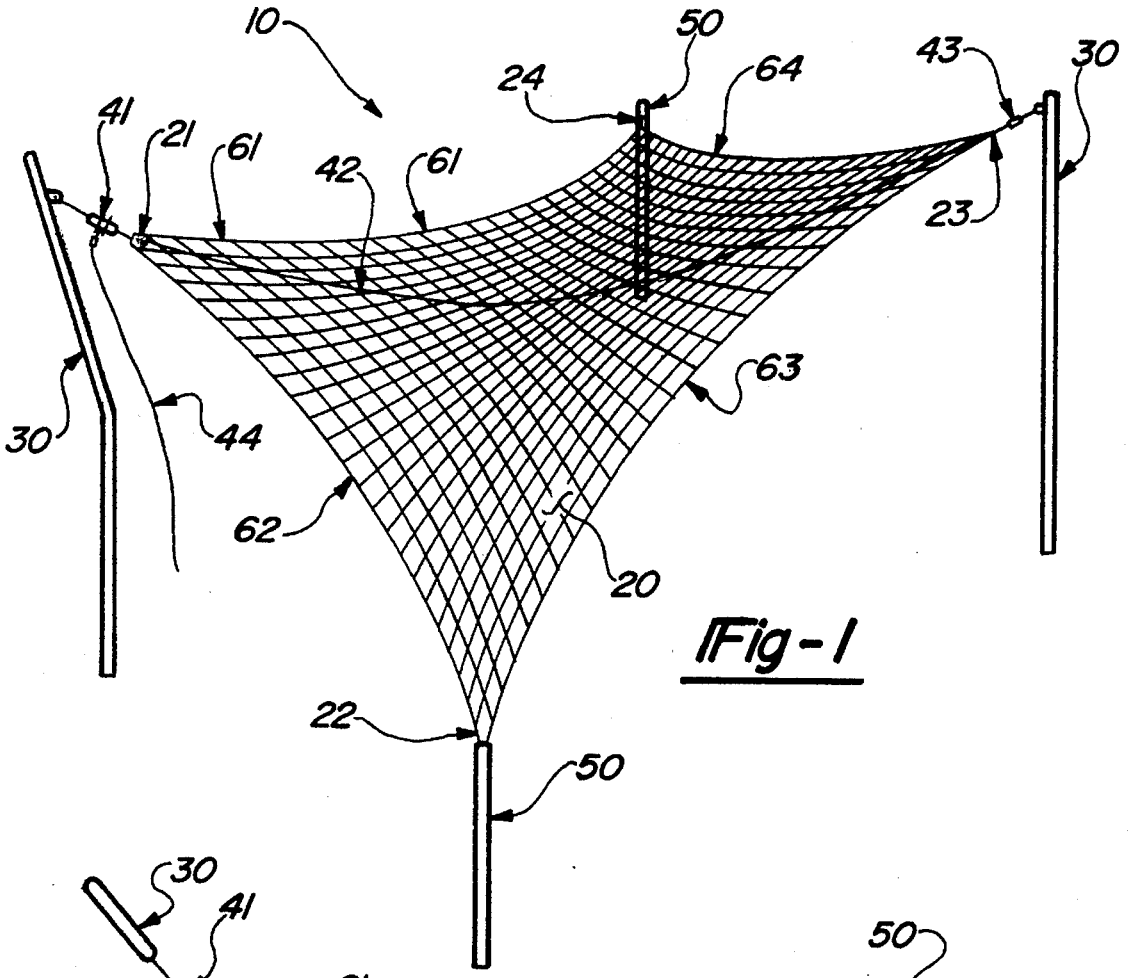
FIG. 1 is a perspective view of a fully erected canopy assembly according to a first embodiment of the present invention.
Figure 2:
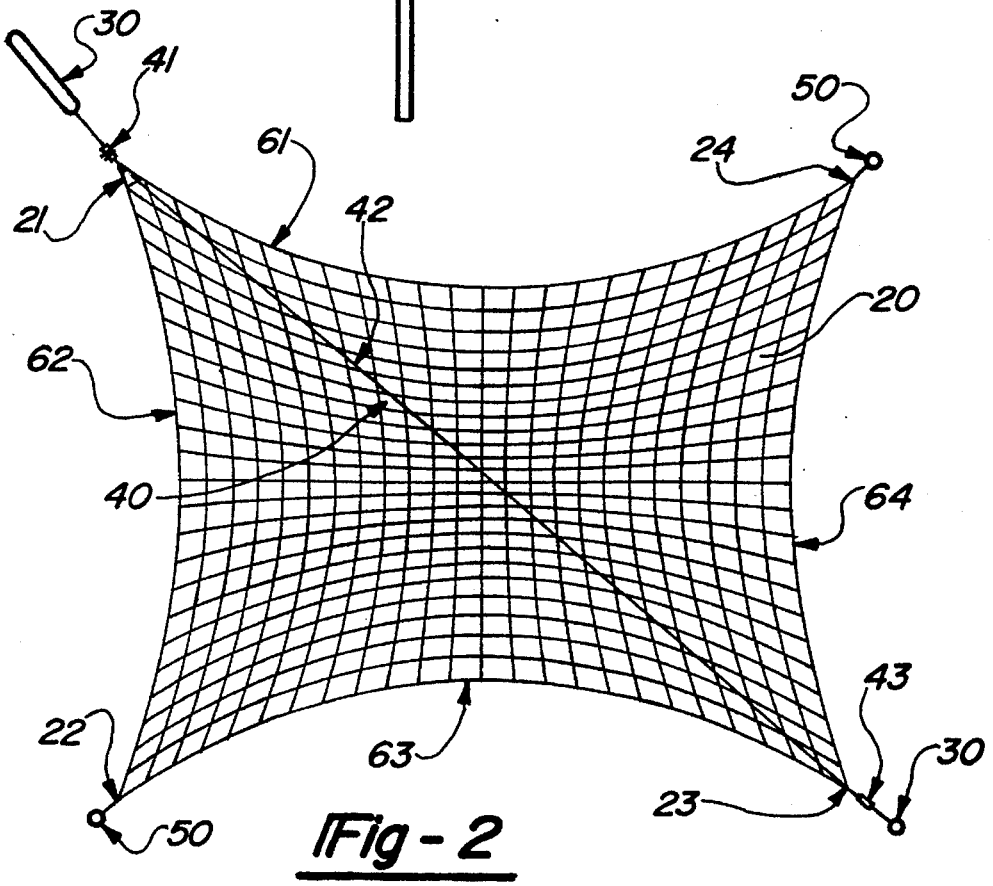
FIG. 2 is a plan view of the canopy assembly of FIG. 1.

The canopy assembly 10 shown in FIGS. 1 and 2 comprises a canopy fabric or cloth 20 held above the ground and supported by appropriate support means. In this instance the canopy fabric is cut as a simple square or rectangular web preferably with curved sides to assist in correct tensioning of the structure as will be explained hereinafter. However virtually any shape imaginable may be used for the canopy fabric. The canopy fabric or cloth 20 has four corners 21, 22, 23 and 24. Diagonally opposite corners 21 and 23 are connected to upstanding supports 30, which are preferably high enough (eg, 2.5 meters) to allow traffic to easily move about underneath the furled or unfurled canopy. Alternate corners 22, 24 are connected to the ground or posts 50 spaced on either side of the diagonal extending between supports 30.

A furling means 40 (see FIG. 2) extends along the diagonal of the canopy fabric 20 between supports 30. In this embodiment, the furling means 40 comprises a cable 42 with a furling reel 41 at one end and a swivel 43 at the other end. Equally, the furling means could include a series of articulated rigid segments instead of cable 42. The furling reel 41 is rotated by line 44 and may operate in a manner similar to a sail jib furler used in yachting.

The cable 42 stretching across the canopy fabric 20 transfers the rotational movement of reel 41 to the swivel 43. The rotational connection at either end allows the cable 42 to rotate evenly along its length and An turn effect even furling and unfurling along the diagonal of the canopy fabric 20. In this way, the canopy may be easily extended or retracted as desired.

Further, by furling/unfurling the canopy from both sides of the furling cable, even tension may be applied to both sides of the canopy to prevent creasing/wrinkling of the fabric, reduce the stress applied to the furling means 40 and reduce the amount of time required to furl or deploy the canopy.

The canopy further comprises a plurality of peripheral tensioning cables 61,62,63 and 64 running between the corners of the canopy fabric. These cables tension the fabric to give it the desired taut, curved shape as will be explained below.

The first procedure is the initial setting up of the canopy. This setting up defines the shape, geometry and overall tension of the inventive canopy assembly.

The canopy is first spread out and the positions of the corners 21, 22, 23 and 24 roughly defined. Supports 30 will be positioned to support corners 21 and 23 at either end of furling means 40. Alternate corners 22 and 24 wall be connected to appropriately positioned posts 50.

Tensioning of the canopy fabric to obtain the desired curved shape is accomplished by peripheral cables 61–64. The position of the corners 21–24 in conjunction with the tension in cables 61–64 is adjusted to give the desired shape and geometry of the canopy fabric 20. Each corner of the canopy fabric preferably includes a tensioner which adjusts and maintains the desired length and tension in the respective peripheral cable. As will be clear to persons skilled in the art, by altering the length and tension of peripheral cable 61–64 between the corners 21–24 and adjusting the position of corners 21–24 by means of an assembly connecting each corner to its respective support 30 or post 50, the shape of the canopy is defined.

Once the correct tension in peripheral cables 61–64 is set and the corners 21–24 are correctly positioned, the cables are locked off to thereby maintain the desired shape and geometry of the canopy fabric 20. After the initial setting up procedure, future deployment of the inventive canopy assembly is a simple manner of unfurling the canopy, connecting corners 22 and 24 to posts 50 with all retensioning of the canopy fabric being accomplished at one corner 21.

To explain, in this embodiment the aforementioned adjustable tensioning means such as a block and tackle is provided at corner 21. Of course, different shapes of canopy fabric, and/or those with two or more furling means, may require more than one adjustable tensioning means.

Let us assume the canopy fabric 20 has Just been unfurled and is hanging loosely from either side of the furling means 40. In order to return the canopy to its initial set up or taut condition, the correct tension must be applied through peripheral cables 61–64 and all corners 21–24 must be in their correct position. Corner 23 at one end of the furling means is already in its correct position. Diagonally opposite corners 22 and 24 are returned to their correct positions by connecting them to posts 50. Preferably these posts are permanently embedded in the ground. In this condition, corners 22, 23 and 24 are in their correct position however, the correct tension has not been applied through peripheral cables 61–64. To apply this correct tension it is a simple matter of pulling on corner 21 via the adjustable tensioning means to move it toward support 30. This movement not only correctly positions corner 21 but simultaneously applies the correct tension through peripheral cables 61–64. It will be clear to persons skilled in the art that once corners 21–24 are in their correct positions the correct tension will have been applied through cables 61–64 and the canopy 20 will have the desired shape and geometry.

It should be noted that, in use, these peripheral cables 61–64 provide even tension along the entire edge of the fabric. Each cable is preferably slightly curved to match the concave curved edge of the canopy fabric such that it pulls the respective edge of the fabric outwardly, is, tension is applied in a direction normal to the edge of the fabric. This four-way tensioning by peripheral cables 61–64 ensures a smooth, taut, curved canopy fabric 20.

Figure 3A:
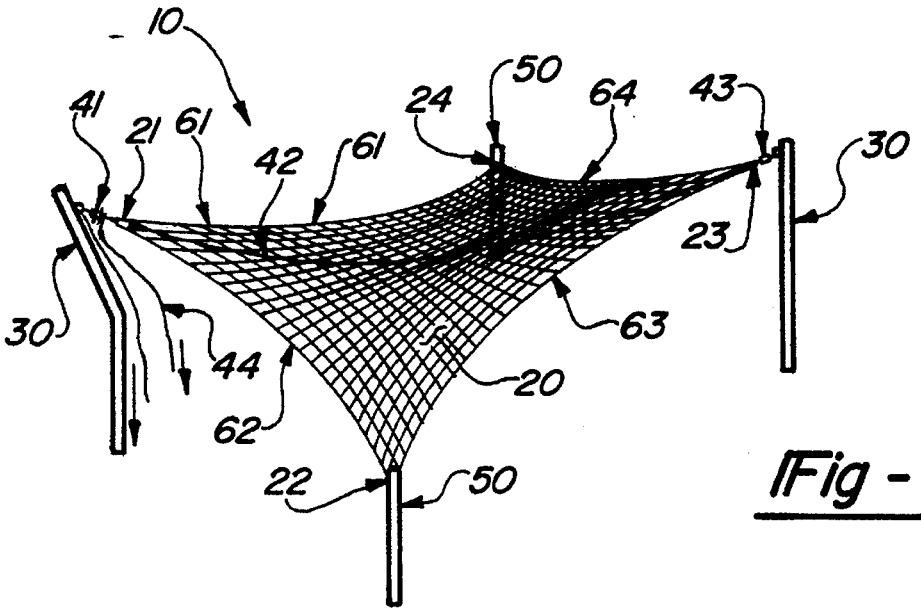
Figure 3B:
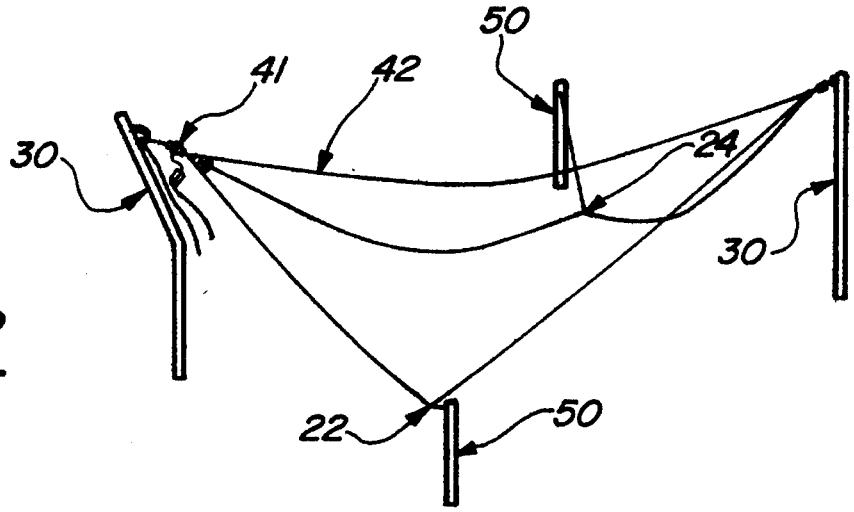

Referring now to FIGS. 3A–E it is a simple matter to return the canopy to is furled condition from its deployed or unfurled condition shown in FIG. 3A. Firstly, as shown in FIG. 3B the tethers holding corners 22 and 24 to posts 50 are released.

Figure 3C:
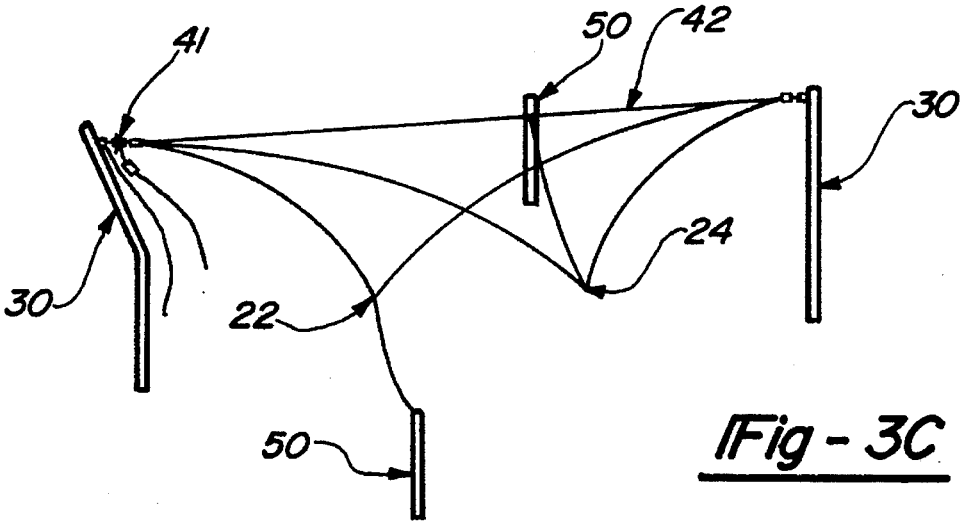
Figure 3D:
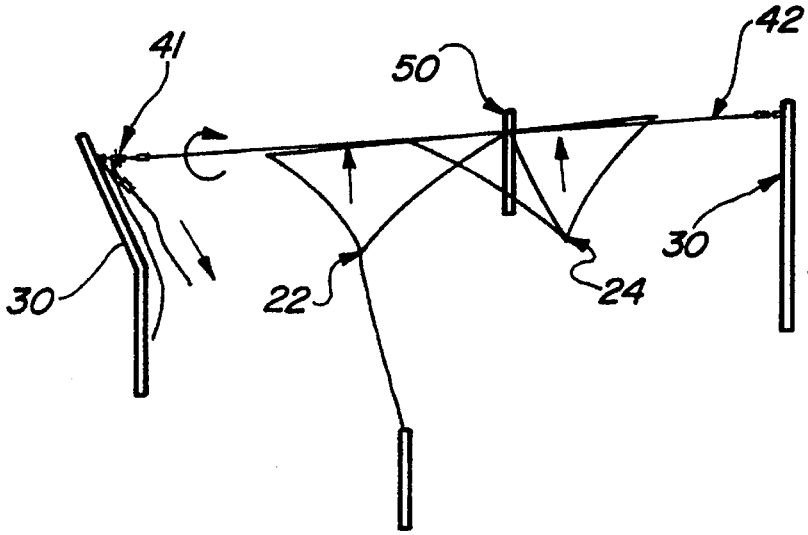
Figure 3E:
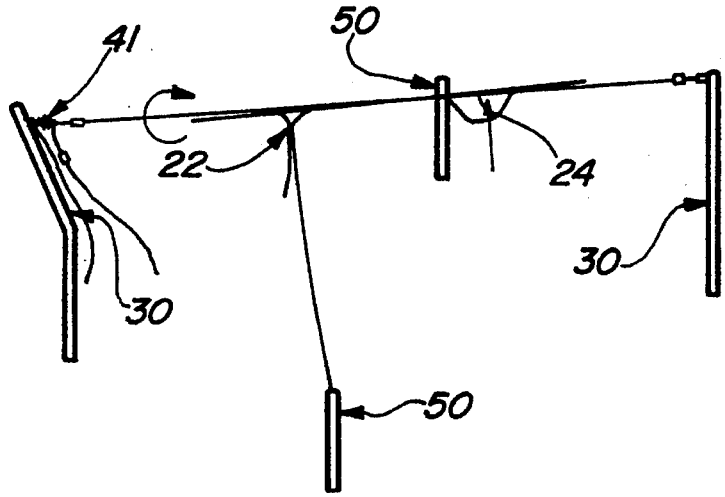

As shown in FIG. 3C, the tension in furling cable 42 is then increased to provide a substantially straight furling edge. This is preferably accomplished by moving furling reel 41 towards support 30. When furling cable 42 is essentially straight, it is then a simple matter of rotating furling reel 41 by means of line 44 to furl both sides of canopy fabric 20 onto the cable 42 (FIG. 3D) until the fabric is completely wound onto the furling cable as shown in FIG. 3E.

Of course for redeploying the canopy an operator will pull on the tethers attached to corners 21–24 until the canopy is fully unfurled, the tensioning in furling cable 42 is then released and the corners 22, 23 and 24 attached to posts 50 and supports 30 with the retensioning of the canopy fabric 20 being accomplished by the adjustable tensioning means which pulls corner 21 towards support 30, as discussed above.

In the embodiment shown, the canopy fabric or cloth is cut as a square with curved edges such that the tensioned canopy assembly forms an hyperbolic paraboloid. As mentioned above, however, virtually any shape of canopy fabric or cloth may be used with the present inventive canopy assembly.

By providing a furling means 40 extending through the body of the fabric 20, as opposed to furling/unfurling from an edge of the fabric, an operator may ensure the canopy is furled neatly and smoothly with a minimum of wrinkling or creasing. In addition to providing the taut, aesthetically pleasing canopy, the present invention allows tensioning in at least two directions to increase the structural integrity of the canopy assembly. Further, by providing a furling means which is straight during furling and relaxed when the canopy is erected, the furling system may conform to any desired curved shape of the erected canopy assembly and the furling system does not restrict the shape of the canopy to flat or near flat shapes.

The present inventive canopy assembly provides adjustable tensioning of the canopy fabric in at least two directions by means of peripheral cables 61–64 alone or in conjunction with furling cable 42. This provides a taut, tensioned structure which can withstand substantial vertical and transverse loads from wind, rain, snow, hail, leaves, etc. To assist in maintaining this taut structure, supports 30 may be formed as resilient members. In the embodiment shown, the left hand support 30 is also slightly bent or offset to allow for movement of the furling reel 41 toward the support when the furling cable is tensioned from its curved shape to its relatively straight shape for furling.

Turning now to FIGS. 4 and 5, furling of the canopy fabric or cloth 20 is preferably accomplished by means of furler reel 41 connected to a cable 42 which passes along the surface of the canopy fabric or cloth 20 to a swivel 43 on diagonally opposite corner 23 (see FIGS. 1 and 2) of the canopy fabric or cloth. Preferably the cable 42 is taped to the fabric 20 to prevent slip during rotation. A furling line 44 (see FIG. 4) wraps around the furling reel 41. Pulling on this furling line 44 effects rotation of the reel which in turn rotates the furling cable thereby transmitting the rotational movement to barrel or swivel 43 at the other end of the cable. This ensures that diagonally opposite corners 21, 23 are rotated at the same time to effect even furling of the canopy fabric or cloth 20.

As mentioned above, it is preferable that each corner 21–24 includes a means for maintaining and/or setting tension in the peripheral cables 61–64, such that after the initial tensioning and setting up of the canopy, future erection is simply a matter of unfurling the fabric and hooking the corners 22 and 24 to post 50, with appropriate retensioning of canopy at corner 21 as desired. No alteration of the length of peripheral cables 61–64 or the position of corner should be required.

As shown in FIGS. 4 and 5, corner 21 is preferably provided with a passive tensioner 45 which maintains the correct tension in peripheral cables 61,62. This passive tensioner 45 is connected to reel 41 such that it rotates with reel 41. This rotation is then transmitted by furling cable 42, also connected to passive tensioner 45, to the diagonally opposite end 23 of the canopy fabric or cloth. Preferably, a corresponding passive tensioner is provided at corner 23 and connected in the same way to furling cable 42 and swivel 43.

Passive tensioner 45 preferably includes sheaves 46 and cable grips 47 which hold tensioning cables 61,62, (63,64) running along the peripheral edges of the canopy fabric 20.

Furling reel 41 is connected to support means 30 by means of tensioning assembly 35 comprising shackle 36, swivel pulley 37 and tensioning cable 38. As mentioned above, when erecting the canopy assembly at certain times it is desired to hold cable 42 extremely tightly while on other occasions it is preferred that the furling cable is slack. This tension adjustment of furling cable 42 and the adjustment of the position of corner 21 is accomplished by means of tensioning assembly 35. Tensioning cable 38 extends from furler reel 41 through swivel 38 to a mechanical tensioning device such as a winch, block and tackle, pulley system, etc. Fulling downwardly on this tensioning cable 38 will pull furler reel 41 and corner 21 towards support means 30 thereby straightening furling cable 42. The furling cable 42 may be attached to the respective passive tensioner at opposite corners 21, 23 by any appropriate means including the swage fork 49 shown in FIG. 5.

Turning to FIGS. 6–8 these drawings display a preferred active tensioner to adjust tension in the peripheral tensioning cables 61–64 during the initial set-up procedure and consequently set the desired shape and geometry of canopy fabric 20. The active tensioner 100 comprises tensioner base 110 and frame 120 on which are rotatably mounted a pair of sheaves 111 and tension ratchet wheels 112.

The active tensioner 100 is preferably attached to corners 22,24 of the canopy fabric or cloth 20 and secured by tensioning ropes 121. Peripheral cables 61,64 or 62,63 extending along the periphery of the canopy fabric 20, from the one corner to the next, pass along sheaves 111 through cable grips 113 and wrap around ratchet wheels 112. Accordingly, it will be seen that each peripheral cable 61–64 is held at one end by a passive tensioner 45 and at the other by active tensioner 100. By rotating ratchet wheels 112 the tension in the peripheral cables 61,64 or 62,63 may be adjusted in order to ensure a smooth, clean, curved edge on the canopy fabric 20. Ratchet spring 114 engages wheel 112 to maintain the desired tension. Tensioning of these cables also adjusts the shape of the canopy fabric 20 and alters its rigidity. The cable grips 113 hold the desired tension in cables 61,64 or 62,63 after the appropriate "setting up" adjustments have been made.

This active tensioner 100 may be attached directly to the ground or to low support posts 50, by any appropriate mechanism. In this instance, the active tensioner 100 is attached to low posts 50 by means of an assembly 115 which is virtually identical to the tensioning assembly 35 shown in FIG. 5. This assembly 115 comprises cleat 116, shackle 117, swivel pulley 118 and tensioning cable 119. The tensioning cable 119 acts as the tether referred to in FIGS. 3A–E to assist in erection of the canopy.

Unlike the assembly 35 positioned at corner 21 (see FIG. 5), however, in the embodiment shown no mechanical tensioning device is required at the other three corners 22, 23 and 24. A holding device such as a halyard catch bracket may be provided at these locations to hold the corners of their preset positions. At corners 22 and 24, cable 119 passes from tensioner frame 120 through swivel pulley 118 to the holding means or catch bracket on low post 50. This allows the easy and quick connection of corners 22,24 on either side of the canopy fabric 20 to the posts 50, the correct tension in cables 61,64 or 62,63 being previously set by tensioner 100.

Similarly at corner 23 a cable connects passive tensioner 45 to its respective support post 30. This cable will also pass through a swivel pulley to a holding means or catch bracket on its respective support post 50.

The present invention provides a canopy assembly with a number of tensioning means on each of its corners to adjust the overall shape, appearance and structural rigidity of the canopy assembly. Further, the furling means, which extends along the canopy fabric at an intermediate position within the canopy fabric as opposed to an edge of the canopy, allows furling/unfurling of the canopy fabric to be accomplished simultaneously from both sides and more easily, quickly and neatly than the prior art. The furling means may also be altered from a straight furling condition to an erected or curved condition in which the furling means conforms to the curved shape of the erected canopy.

The inventive canopy has no rigid structure within the canopy fabric and consequently is very light, allowing construction of a very large canopy without the need for large support structures or scaffolding. Further, the taut curved canopy shape, in addition to the light weight of the furling means, avoids the need for extensive support structures underneath the canopy fabric. Conventional permanent or collapsible assemblies usually comprise a series of flat panels connected by appropriate framework. These flat panels are quite susceptible to wind gusts and normally require extensive framework or scaffolding. Such framework or scaffolding requires correspondingly hefty support structures to keep them in place. The light curved structure of the inventive canopy assembly resists wind gusts and can span across large areas without the need for intermediate support structures under the canopy fabric. The plurality of anchor points and tensioning cables ensures that the canopy is stable and strong with the curved shape providing good run off of debris and water etc, as well as being aesthetically pleasing. By using such flexible furling means, the canopy is not limited or defined by the shape of the furling means, thereby providing a high degree of flexibility with regard to the canopy shape and size.

It is also possible with the inventive canopy assembly to configure the canopy to such a shape that it readily sheds debris, water, etc or concentrates this run-off into a small area which makes it easy to avoid when entering the area under the canopy. This can be compared with collapsible assemblies such as umbrellas which tend to shed run-off uniformly around their perimeter.

It will be appreciated by persons skilled in the that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A canopy assembly comprising a canopy fabric having side portions bounded by a fabric edge, at least one pair of suspension points being provided at said fabric edge at opposed side portions of said fabric, at least one pair of supports, each support being connected to one of said suspension points and adapted to suspend said canopy fabric above the ground, furling means extending across said canopy fabric between said supports wherein said fabric is adapted to be simultaneously unfurled in opposed directions from said furling means such that in an erected condition said fabric extends from opposite sides of said furling means and a plurality of anchor points at said fabric edge and spaced from said suspension points, for tethering said fabric to the ground when said fabric is at least in part unfurled from said furling means.

2. A canopy assembly as claimed in claim 1, wherein said furling means comprises a flexible cord.

3. A canopy assembly as claimed in claim least one end of said furling means is connected to a support by a tensioner adapted to alter the tension in the furling means.

4. A canopy assembly as claimed in claim 1, wherein said furling means comprises a furling reel adjacent one of said supports, a swivel adjacent the other of said supports and a flexible coupling extending therebetween to transfer rotational movement from said reel to said swivel.

5. A canopy assembly as claimed in claim 4 wherein one of said furling reel and swivel are movable relative to a respective support to thereby alter tension in the flexible coupling.

6. A canopy assembly as claimed in claim 1 wherein said canopy fabric has a plurality of corners, said anchor points being provided on said corners.

7. A canopy assembly as claimed in claim 1 wherein said canopy fabric comprises a plurality of corners with a plurality of periphery tensioning cables extending along said fabric edge between said corners of said fabric.

8. A canopy assembly as claimed in claim 1 comprising at least two of said furling means extending along said canopy fabric and at least three of said supports with each furling means extending between at least two supports.

9. A canopy assembly as claimed in claim 1, wherein said furling means comprises a cable.

10. A canopy assembly as claimed in claim 1, wherein said furling means comprises a plurality of articulated elements.

11. A canopy assembly as claimed in claim 1, wherein said canopy fabric is substantially polygonal in shape with a plurality of comers joined by a plurality of side edges, said side edges being slightly concave.

12. A canopy assembly as claimed in claim 7 wherein each corner of said canopy fabric is provided with a tensioner, each peripheral cable extending between at least two of said tensioners to alter the tension of the respective peripheral cable.

13. A canopy assembly as claimed in claim 7 wherein at least one corner of said canopy fabric is provided with a adjustable tensioning means, said adjustable tensioning means being arranged to alter the distance between said corner and the connection of said corner with one of the ground and its respective support to thereby alter the tension of said canopy fabric and said peripheral cables.

14. A canopy assembly comprising a canopy fabric having side portions bounded by a fabric edge, at least one pair of suspension points being provided on or adjacent said fabric edge at opposed side portions of said fabric, at least one pair of supports, each support being connected to one of said suspension points and adapted to suspend said canopy fabric above the ground, and a furling means extending across said canopy fabric between said supports wherein in a furling condition, said furling means is substantially straight to allow said fabric to be simultaneously unfurled in opposed directions from said furling means and, in an erected condition said furling means conforms to the curved shape of the canopy fabric extending from opposite sides of said furling means.

15. A canopy assembly as claimed in claim 14 wherein said furling means comprises a flexible cord.

16. A canopy assembly as claimed in claim 15 wherein at least one end of said furling means is connected to a support by a tensioner adapted to alter the tension in the furling means.

17. A canopy assembly as claimed in claim 14 wherein said furling means comprises a furling reel adjacent one of said supports, a swivel adjacent the other of said supports and a flexible coupling extending therebetween to transfer rotational movement from said wheel to said swivel.

18. A canopy assembly as claimed in claim 17 wherein one of said furling reel and said swivel are moveable relative to a respective support to thereby alter the tension in the flexible coupling.

19. A canopy assembly as claimed in claim 14 wherein said canopy fabric comprises a plurality of corners with a plurality of peripheral tensioning cables extending along said fabric edge between said corners of the fabric.

20. A canopy assembly as claimed in claim 14 wherein said furling means comprises a cable.

21. A canopy assembly as claimed in claim 14 wherein said furling means comprises plurality of articulated rigid elements.

22. A canopy assembly as claimed in claim 1 wherein said canopy fabric is substantially polygonal in shape with a plurality of comers joined by a plurality of side edges, said side edges being slightly concave.

23. A canopy assembly as claimed in claim 19 wherein each corner of said canopy fabric is provided with a tensioner, each peripheral cable extending between at least two of said tensioners to alter the tension of a respective peripheral cable.

24. A canopy assembly as claimed in claim 19 wherein at least one corner of said canopy fabric is provided with an adjustable tensioning means, said adjustable tensioning means being arranged to alter the distance between said corner and the connection of said corner with the ground or its respective support, to thereby alter the tension of said canopy fabric and said peripheral cables.

25. A method for erecting a canopy comprising the steps of:

providing a canopy fabric, providing a pair of spaced apart supports, positioning said supports on opposed sides of said canopy fabric, suspending said canopy fabric above the ground by connecting said fabric to said supports with a furling means extending across said canopy fabric between said supports, and unfurling said canopy fabric simultaneously in opposed directions from said furling means such that in an erected condition said fabric extends from opposite sides of said furling means.

26. A method as claimed in claim 25 further comprising the step of:

tensioning free edges of said canopy fabric such that the erected canopy fabric conforms curved hyperbolic paraboloid shape.

27. A method as claimed in claim 25 wherein after said canopy fabric is unfurled, free edges of said canopy fabric are connected to the ground or attached to anchor(s) posts by tethers.

28. A method as claimed in claim 25 wherein prior to said canopy fabric being unfurled, said furling means is tensioned to provide a substantially straight furling means.

29. A method as claimed in claim 26 wherein after said canopy fabric is unfurled said furling means is relaxed to conform to said curved hyperbolic paraboloid shape of said canopy fabric.

30. A method as claimed in claim 26 wherein said canopy fabric is polygonal in shape with a plurality of comers joined by a plurality of side edges, with peripheral tensioning cables extending along said side edges of said canopy fabric between comers of said canopy fabric such that said canopy fabric has been unfurled, tension is applied to said cables to hold said canopy fabric taut.

31. A method for erecting a canopy as claimed in claim 26, said method further comprising the steps of:

providing a plurality of tensioning cables along said free edges of said canopy fabric, setting a desired length of each peripheral cable between comers of said canopy fabric and applying a desired tension simultaneously to all said tensioning cables by adjusting the distance between a corner of said canopy fabric and the connection of said corner with the ground or its respective support.

32. A canopy assembly as claimed in claim 14 further comprising at least two : of said furling means extending across the canopy fabric, and at least three of said supports with each furling means extending between at least two supports.

* * * * *

UNITED STATES PATENT AND TRADEMARK OFFICE

CERTIFICATE OF CORRECTION

PATENT NO. : 5,622,197
DATED : April 22, 1997
INVENTOR(S) : Trevor Valaire

It is certified that error appears in the above-indentified patent and that said Letters Patent is hereby corrected as shown below:

Column 3, line 26, delete "An", insert --in--.
Column 3, line 47, delete "wall", insert --will--.
Column 4, line 9, delete "Just", insert --just--.
Column 6, line 5, delete "Fulling", insert --Pulling--.
Column 7, line 60, insert --2, wherein at-- after the word "claim".
Column 8, line 23, "comers" should be --corners--.
Column 8, line 31, "a" should be --an--.
Column 10, line 16, "comers" should be --corners--.
Column 10, line 19, "comers" should be --corners--.
Column 10, line 29, "comers" should be --corners--.

Signed and Sealed this

Nineteenth Day of August, 1997

*Attest:*

Bruce Lehman

BRUCE LEHMAN

*Attesting Officer*

*Commissioner of Patents and Trademarks*